US006193351B1

(12) United States Patent
Yaegashi et al.

(10) Patent No.: US 6,193,351 B1
(45) **Date of Patent: *Feb. 27, 2001**

(54) SYSTEM TO PERFORM INK JET PRINTING HEAD RECOVERY

(75) Inventors: Hisao Yaegashi, Kawasaki; Isao Ebisawa, Yokohama; Atsushi Arai, Kawasaki; Hidehiko Kanda, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/754,593

(22) Filed: Nov. 25, 1996

(30) Foreign Application Priority Data

Nov. 27, 1995 (JP) ..... 7-307585

(51) Int. Cl.[7] ..... B41J 2/165; B41J 29/393
(52) U.S. Cl. ..... 347/23; 347/19
(58) Field of Search ..... 347/23, 19, 14

(56) References Cited

U.S. PATENT DOCUMENTS

| | | | |
|---|---|---|---|
| 4,313,124 | 1/1982 | Hara | 347/57 |
| 4,345,362 | 8/1982 | Shirato et al. | 347/57 |
| 4,459,600 | 7/1984 | Sato et al. | 347/56 |
| 4,463,359 | 7/1984 | Ayata et al. | 347/57 |
| 4,558,333 | 12/1985 | Sugitani et al. | 347/47 |
| 4,608,577 | 8/1986 | Hori | 347/66 |
| 4,723,129 | 2/1988 | Endo et al. | 347/57 |
| 4,740,796 | 4/1988 | Endo et al. | 347/56 |
| 5,172,140 | 12/1992 | Hirabayashi et al. | 347/36 |
| 5,289,207 | 2/1994 | Ebisawa | 347/23 |
| 5,428,380 | 6/1995 | Ebisawa | 347/35 |
| 5,781,204 * | 7/1998 | Kanematsu et al. | 347/23 |
| 5,805,180 * | 9/1998 | Ebisawa et al. | 347/23 |

FOREIGN PATENT DOCUMENTS

| | | | |
|---|---|---|---|
| 54-056847 | 5/1979 | (JP) | B41M/5/26 |
| 59-123670 | 7/1984 | (JP) | B41J/3/04 |
| 59-138461 | 8/1984 | (JP) | B41J/3/04 |
| 60-071260 | 4/1985 | (JP) | B41J/3/04 |
| 05-208505 | 8/1993 | (JP) | B41J/2/175 |

* cited by examiner

*Primary Examiner*—N. Le
*Assistant Examiner*—Thien Tran
(74) *Attorney, Agent, or Firm*—Fitzpatrick, Cella, Harper & Scinto

(57) ABSTRACT

An ink jet printing system to perform printing by ejecting ink toward a printing medium by employing a printing head having ink passages for ejecting ink through ejection openings and a common ink chamber supplying the ink into the ink passages. The system includes detection of a peripheral temperature of the printing head, detection of a variation of a temperature within the printing head, count of a number of times of ejection of the ink, performance of a suction recovery operation for sucking and discharging at least the ink from the printing head through the ejection openings, set of a timing for a next suction recovery operation based on the peripheral temperature of the printing head, the temperature variation within the printing head, and the number of times of ejection of the ink, correction of the number of times of ejection of the ink for setting the timing for the next suction recovery operation based on a difference between the peripheral temperature of the printing head and the temperature variation within the printing head, performance of preparatory ejection for ejecting the ink through the ejection openings toward an object other than the printing medium, and set of a timing for a next preparatory ejection based on the peripheral temperature of the printing head and the temperature variation within the printing head.

15 Claims, 15 Drawing Sheets

SYSTEM TO PERFORM INK JET PRINTING HEAD RECOVERY

BACKGROUND OF THE INVENTION

1. Field of the Invention

The present invention relates generally to an ink-jet printing method and an apparatus therefor in which suction recovery operation is performed for maintaining reliability of an ejecting function of a printing head performing printing by ejecting an ink droplet.

2. Description of the Related Art

A printing apparatus, such as for a printer, a copy machine, facsimile and so forth, is generally constructed to print an image consisted of a dot pattern on a printing medium, such as a paper, plastic film, cloth or so forth on the basis of an image information.

Such printing apparatus can be classified as an ink-jet type, a wire-dot type, laser-beam type and so forth based on its printing system.

A printing apparatus employing the ink-jet system performs printing by ejecting an ink on a printing medium. Such a printing apparatus holds advantages in capability of high speed printing of high definition image, lesser noise for non-impact type printing, and easiness of printing of a color image using multi-color inks.

Furthermore, a bubble-jet printing system proposed by the owner of the present invention can more easily realize high resolution and high speed printing. In such printing system, it is an important technology to maintain reliability of an ink ejecting function of a printing head in order to avoid influence of evaporation of ink, admixing of fine bubble or so forth for printing quality.

As typical technology for maintaining reliability of the ink ejecting function, a preparatory ejection process and a suction recovery process can be considered.

The preparatory ejection process is to perform ejection of ink at a position out of the printing medium. By this process, the ink degraded in viewpoint of ejection performance and printing quality due to partial evaporation of a volatile component is ejected through ejection openings which have not been used a while, for maintaining good printing quality.

Such preparatory ejection is a measure for evaporation of ink and has to be performed frequently at high environmental temperature or when elevation of temperature in the printing head is large. It should be noted that an interval of the preparatory ejection process is variable depending upon a construction of the printing head and/or physical property of the ink. However, the interval is typically several seconds to several tens of seconds. For performing the preparatory ejection, the time interval to next preparatory ejection is set on the basis of an instantaneous environmental temperature and degree of temperature elevation of the printing head.

On the other hand, the suction recovery process is a process to position the printing head in opposition of a cap for capping, and thereafter to suck the ink in the printing head via the cap by means of a suction pump for appropriately filling the printing head with the ink when bubble is present in an ink passage storing the ink to be ejected, when recovery by preparatory operation becomes insufficient due to evaporation of the ink in the ink passage or when the ink is consumed out from the ejection opening, the ink passage and an ink chamber.

It should be noted that, in the conventional a bubble-jet printing apparatus, growth speed of bubble depending upon difference between the environmental temperature of the printing head (for example, ink temperature within the ink tank) and the temperature in the ink passage and the ink chamber, is not taken into account in the technology for maintaining reliability. Thus, it can be caused unnecessarily frequent sucking operation to result in lowering of throughput and increasing of waste ink. Conversely, it is also possible to have excessively long interval between suction recovery to result in printing failure.

SUMMARY OF THE INVENTION

The present invention has been worked out in view of the problems in the prior art set forth above. Therefore, it is an object of the present invention to provide an ink-jet printing method and an apparatus therefor, which can optimally perform preparatory ejection and suction recovery for maintaining reliability of ink ejection.

According to a first aspect of the present invention, an ink-jet printing method for performing printing by ejecting ink toward a printing medium by employing a printing head having ink passages for ejecting ink through ejection openings and a common ink chamber supplying the ink into the ink passages, comprises the steps of:

- detecting peripheral temperature of the printing head;
- detecting variation of a temperature within the printing head;
- counting the number of times of ejection of the ink;
- performing suction recovery operation for sucking and discharging at least the ink from the printing head via the ejection openings;
- setting a timing for next suction recovery operation on the basis of the peripheral temperature of the printing head, the temperature variation within the printing head and the number of times of ejection of the ink; and
- correcting the number of times of ejection of the ink for setting the timing for next suction recovery operation on the basis of a difference between the peripheral temperature of the printing head and the temperature within the printing head.

Here, it is possible that the ink-jet printing method further comprises a step of performing preparatory ejection for ejecting the ink through the ejection openings toward other than the printing medium, and a step of setting a timing for next preparatory ejection on the basis of the peripheral temperature of the printing head and the temperature variation in the printing head. In this case, it is preferred that correction of the number of times of ejection of the ink on the basis of the difference between the peripheral temperature of the printing head and the temperature within the printing head, is performed per the preparatory ejection operation.

On the other hand, it is preferred that the timing for next suction recovery operation is the timing when the number of times of ejection of the ink exceeds the preliminarily set threshold value. In this case, the preliminarily set threshold value may be set to be smaller for ink in which it is easier to generate a bubble.

According to a second aspect of the invention, an ink-jet printing apparatus for performing printing by ejecting ink toward a printing medium by employing a printing head having ink passages for ejecting ink through ejection openings and a common ink chamber supplying the ink into the ink passages, comprising:

- means for detecting peripheral temperature of the printing head;
- means for detecting variation of a temperature within the printing head;

means for counting the number of times of ejection of the ink; and suction recovery means for performing suction recovery operation for sucking and discharging at least the ink from the printing head via the ejection openings;

suction recovery control means for setting a timing for next suction recovery operation on the basis of the peripheral temperature of the printing head, the temperature variation within the printing head and the number of times of ejection of the ink; and the suction recovery control means correcting the number of times of ejection of the ink for setting the timing for next suction recovery operation on the basis of a difference between the peripheral temperature of the printing head and the temperature within the printing head.

According to the second aspect of the invention, the suction recovery control means sets a timing of next suction recovery operation on the basis of the number of the times of ejection of the ink corrected based on the peripheral temperature of the printing head, the temperature variation within the printing head, and a difference between the peripheral temperature of the printing head and the temperature within the printing head.

At the timing of suction recovery operation set by the suction recovery control means, the suction recovery means performs the next suction recovery operation for sucking and discharging the ink and bubble from the printing head via the ejection openings.

Here, the ink-jet printing apparatus may further comprise preparatory ejection means for performing preparatory ejection for ejecting the ink through the ejection openings toward other than the printing medium, and preparatory ejection control means for setting a timing for next preparatory ejection on the basis of the peripheral temperature of the printing head and the temperature variation within the printing head. In this case, it is preferred that correction of the number of times of ejection of the ink on the basis of the difference between the peripheral temperature of the printing head and the temperature within the printing head, is performed per the preparatory ejection operation by the preparatory ejection means.

On the other hand, the ink passages of the printing head may be divided into at least two or more blocks. In this case, the printing head may have common ink chambers storing inks of different colors per respective of the blocks, and may be enabled for printing by ejecting the inks of at least two or more colors. In such case, the timing for next suction recovery operation set by the suction recovery control means is preferably the timing when the number of times of ejection of the ink in at least one of the block exceeds a preliminarily set threshold value. Further preferably, the preliminarily set threshold value is set to be smaller for the ink in which it is easier to generate the bubble among the inks in at least two or more blocks.

The inks may be the color inks of yellow, magenta and cyan. In this case, the color ink is preferably a super-permeable ink containing large amount of a surface active agent and having low surface tension.

In the second aspect of the present invention, the printing head may have electrothermal transducers providing thermal energy for the ink for ejection of the ink, in respective of the ink passages. The printing head may be integrally formed with an ink tank storing the ink, may be exchangeably loaded on a carriage for motion in scanning, and may be a serial type to perform printing by ejecting the ink during scanning motion of the carriage. The printing head may also have a connecting portion which enables attaching and detaching to an ink tank storing the ink.

According to the present invention with the ink-jet printing method and apparatus, since the timing of next suction recovery operation by the suction recovery means is set on the basis of the number of times of ejection of ink corrected based on the peripheral temperature of the printing head, the temperature variation within the printing heads and the difference between the peripheral temperature of the printing head and the temperature within the printing head, necessary minimum number of times of suction can be performed with accurately detecting an amount of bubble generated within the printing head.

Also, since the suction recovery operation is performed with taking the amount of bubble to be generated within the printing head into account, highly reliable printing can be performed without lowering throughput as the printing apparatus.

Furthermore, since the preparatory ejection and suction recovery operation are optimally performed, processing performance of the printing apparatus per se can be further improved.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

One embodiment of an ink-jet apparatus which can realize a method according to the present invention will be discussed hereinafter in detail with reference to FIGS. 1 to 15. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
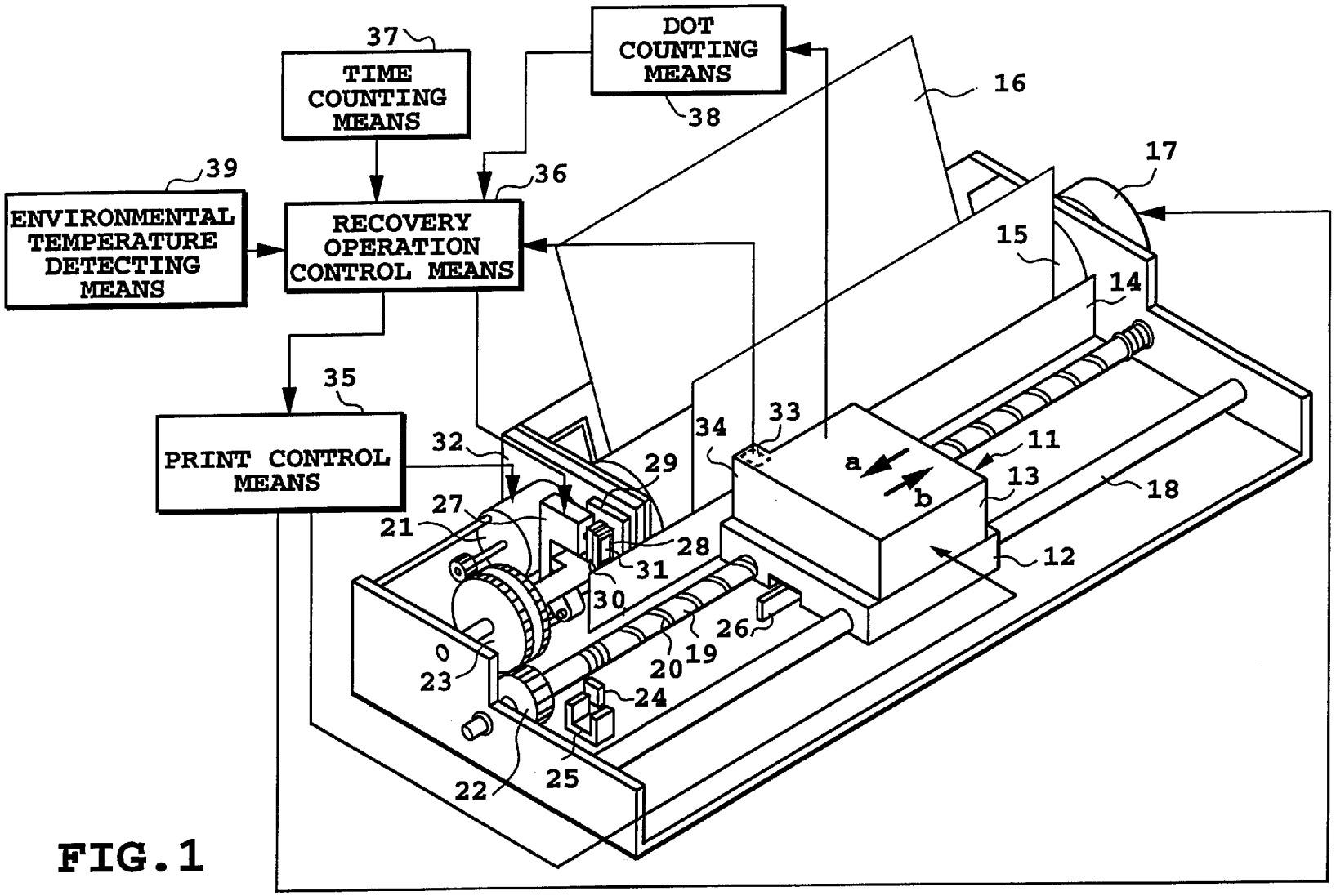
FIG. 1 is a conceptual illustration showing one embodiment of an ink-jet printing apparatus according to the present invention.

One embodiment, in which the present invention is applied to a serial-type ink-jet printing apparatus, is conceptually shown in FIG. 1. The shown embodiment of the ink-jet printing apparatus performs printing with exchangeably loading an ink-jet cartridge 11, in which a printing head and an ink tank are integrated, on a carriage 12. The reference numeral 13 denotes an ink tank of the cartridge 11. On the other hand, the reference numeral 14 denotes a medium guide plate, 15 is a platen for holding a printing medium 16 together with the medium guide plate 14 and feeding the medium 16, and 17 is a medium feeding motor.

The reference numeral 18 denotes a guide shaft for guiding the carriage 12 along the printing medium 16, 19 denotes a lead screw having a spiral groove 20 threadingly engage with the carriage 12 and rotatingly driven by a carriage driving motor 21, 22 and 23 are gears for transmitting a driving force by forward and reverse revolution of the carriage driving motor 21, to the lead screw 19. It should be noted that the carriage 12 travels along arrows a and b along the guide shaft 18 for scanning, and 24 and 25 denote home position detecting means having a photo-coupler. When the carriage 12 is shifted to a home position corresponding to the home position detecting means 24 and 25, a lever 26 provided on the carriage 12 is detected by the home position detecting means 24 and 25 to cause switching of direction of revolution of the carriage driving motor 21.

The reference numeral 27 denotes cap suction means movable in a direction perpendicular to a scanning direction of the carriage 12 together with a cleaning blade 29, at the home position of the carriage 12, 30 denotes a cap supporting member. Recovery operation for eliminating ink of increased viscosity and bubble in the cap member 28 is performed utilizing a driving force of the carriage driving motor 21. The reference numeral 31 denotes an opening portion of the cap member 28, an ejection opening forming surface 40 (see FIG. 2) of the ink-jet cartridge 11 upon suction in suction recovery operation is intimately contacted with the peripheral edge portion of the opening portion 31. On the other hand, the reference numeral 32 denotes a blade supporting member. The blade supporting member 32 is supported for projecting the cleaning blade 29 toward the ejection opening forming surface 40 for wiping the ejection opening forming surface 40 during wiping after suction operation for recovery.

Timing for capping process, cleaning process and suction recovery process will be discussed later. When carriage 12 reaches a region of the home position side, desired processes are performed at corresponding position by the action of the lead screw 19.

The reference numeral 33 denotes temperature detecting means for detecting a temperature of a printing head 34, 35 denotes print control means for controlling a printing operation, 36 denotes recovery operation control means for controlling suction recovery operation and preparatory ejection operation by the cap sucking means 27, 37 denotes a timer which is cleared at every sucking operating by the cap sucking means 27 and the newly initiates time measurement (hereinafter referred to as time counting means), 38 denotes number of ejection counting means (hereinafter referred to as dot counting means) for counting number of times of ink ejection by the printing head 34 including those upon printing and preparatory ejection, 39 denotes environmental temperature detecting means for detecting peripheral temperature of the printing head 34.

It should be noted that the temperature detecting means 21 is not necessarily provided directly on the printing head 34 per se. For instance, any temperature detecting means 21 which constantly permits prediction of the instantaneous temperature of the printing head 34, may be employed.

In the ink-jet printing apparatus constructed as set forth above, primary scan of the ink-jet cartridge 11 by the carriage 12 is performed under control of driving of the carriage driving motor 21 by the printing control means 35. During primary scan, ink ejection is performed through the printing head 34 for performing printing at the predetermined timing. On the other hand, printing for every one cycle of scanning on the printing medium 16 by primary scan, the medium feeing motor 17 is driven for performing feeding of the medium 16. By repetition of the foregoing operation, control is performed for obtaining a desired printed image on the printing medium 16.

It should be noted that the dot counting means 38 counts a number of dots printed by ink ejection from the printing head 34 during printing operation. The counted value is output as a signal to the recovery operation control means 36 according to progress of printing operation. In conjunction therewith, the temperature detected by the temperature detecting means 21 is converted into an electrical signal and output to the recovery operation control means 36. On the other hand, a temperature around the head 34 is detected by the environmental temperature detecting means 39.

Figure 2:
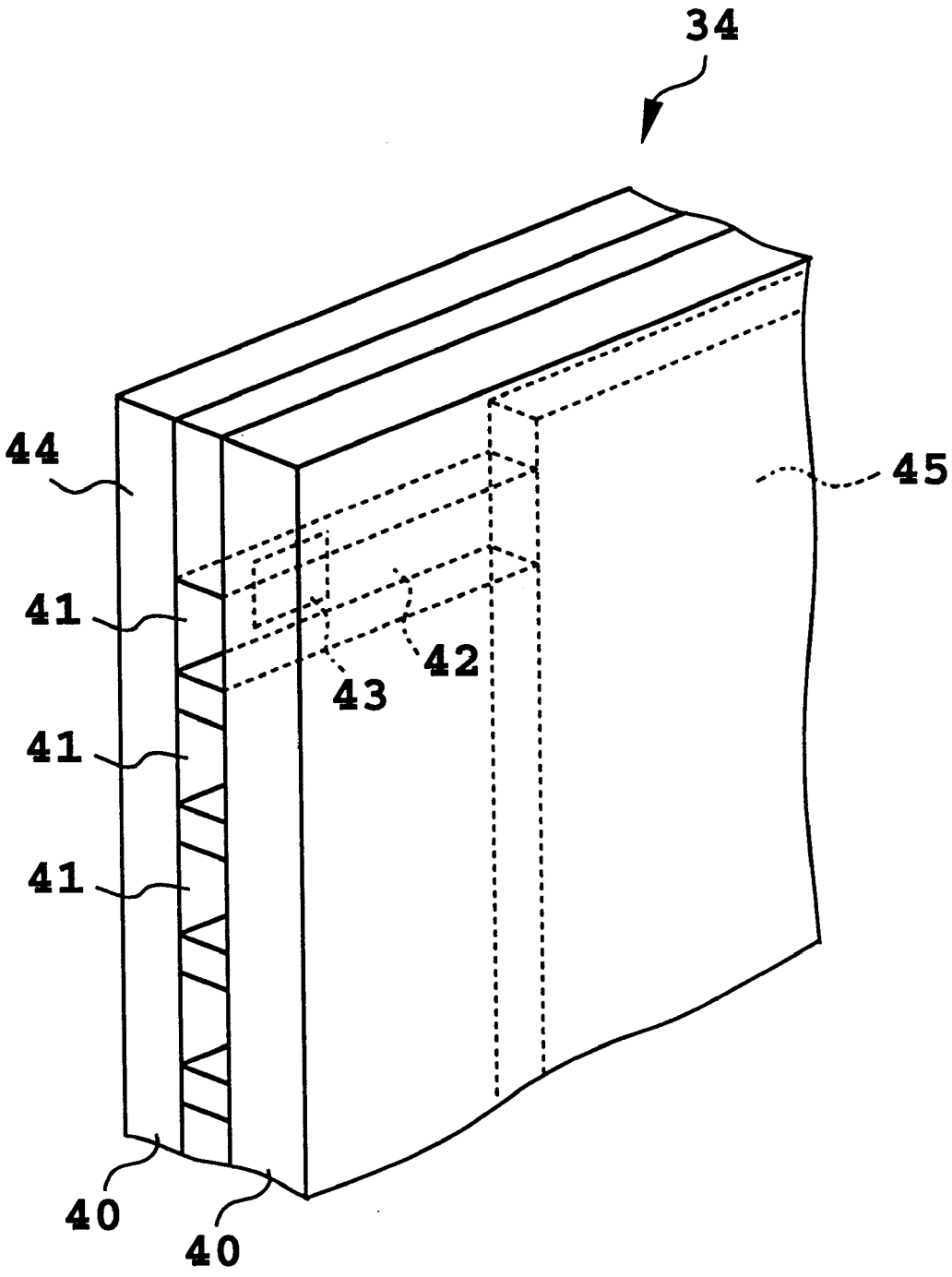
FIG. 2 is an enlarged perspective view of a tip end portion of a printing head to be installed in the ink-jet printing apparatus of FIG. 1.

As shown in FIG. 2, in which a portion of the printing head 34 in the shown embodiment is extracted and shown in enlarged fashion, the printing head 34 is constructed with the ink-jet cartridge 11 integrated with the ink tank 13 as discussed with respect to FIG. 1. In FIG. 2, the reference numeral 40 denotes an ejection opening forming surface which maintains a predetermined distance at a position opposing to the printing medium 16, 41 denote ejection openings arranged on the ejection opening forming surface 40 at a given pitch, 42 denote ink passages for maintaining ink to be ejected through respective of individual ejection openings 41, 43 denote electrothermal transducers formed in respective of ink passages 42 on head substrate 44 as ejection elements generating energy for ejecting the ink, and 45 denotes a common ink chamber receiving supply of the ink from the ink tank 13. Each ink passage 42 is communicated with the common ink chamber 45.

In such printing head 34, the ink supplied from the common ink chamber 45 is introduced into respective ink passages 42 by capillary action to form a meniscus at the ejection opening 41. Then, as set out later, the electrothermal transducer 43 is heated by selective power supply to heat the ink in the ink passage 42. By abrupt heating, the portion of the ink contacting with the electrothermal transducer 43 is abruptly heated. Thus, bubble is generated on the electrothermal transducer 43 opposing to the ink passage 42. By growth of the bubble, the ink is ejected through the ejection opening 41 to form the ink droplet to hit on the printing medium 16 for performing dot printing.

Figure 3:
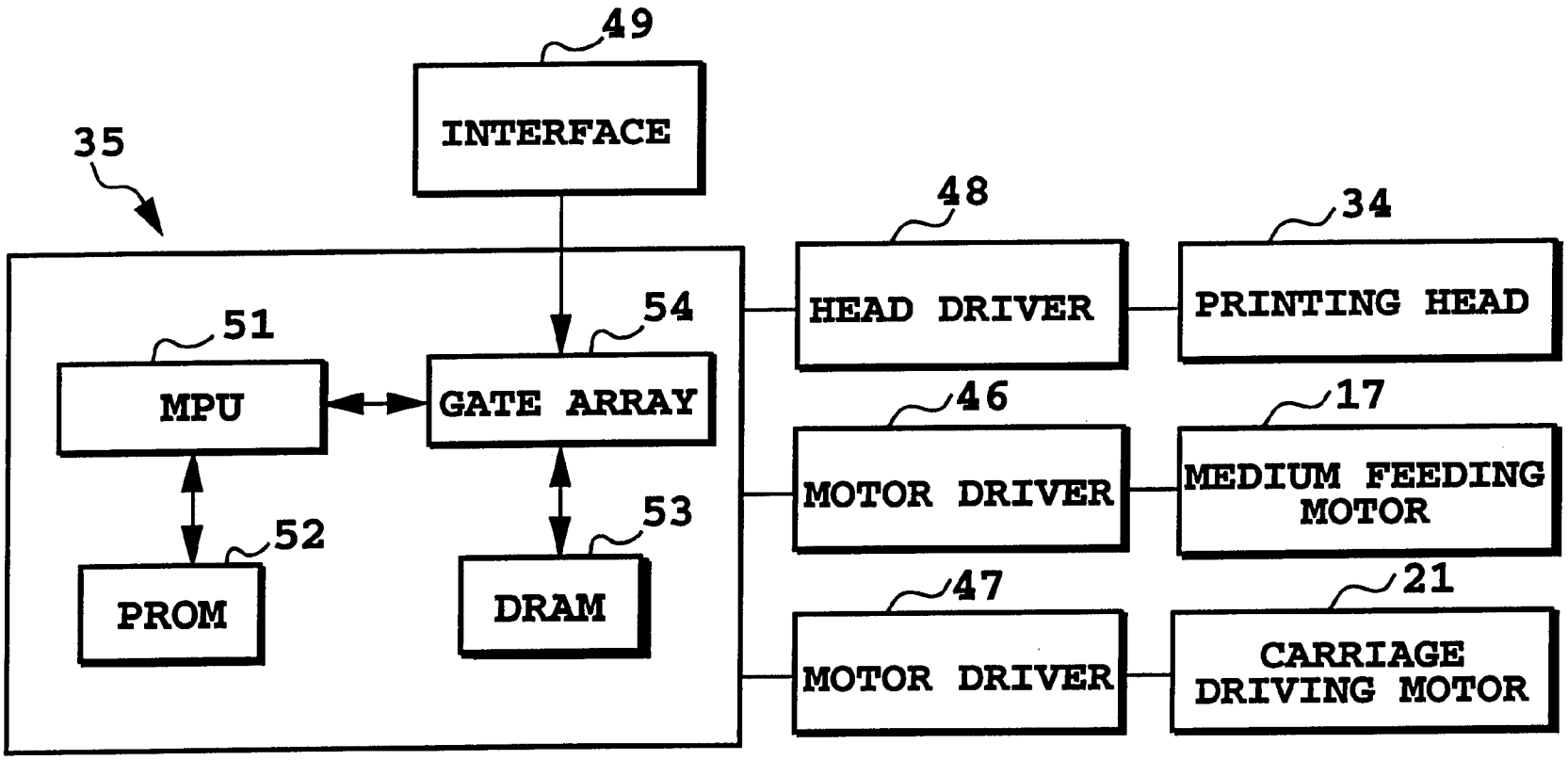
FIG. 3 is a block diagram showing a construction of a control circuit according to the present invention.

Next, according to FIGS. 3 and 4, circuit construction of the printing control means 35 shown in FIG. 1 will be discussed. As set forth above, the printing control means 35 performs driving control for the medium feeding motor 17 and the carriage driving motor 21 at predetermined timing through motor drivers 46 and 47, and further controls printing operation by ink-ejection of the printing head 34 through a head driver 48. The reference numeral 49 denotes an interface for inputting a print signal and other information from a host system 50 side (see FIG. 4). Also, the reference numeral 51 denotes an MPU, 52 denotes a PROM storing control program to be executed by the MPU 51, 53 denotes a DRAM for storing various data (the foregoing print signal, printing data information to be supplied to the printing head 34 and so forth), which can store number of printing dots, number of times of exchanging of the ink tank 13 or the printing head 34 and so forth. The reference numeral 54 denotes a gate array relating to a printing data control for the printing head 34 to perform data transfer control between the interface 49, the MPU 51 and the DRAM 53.

Figure 4:
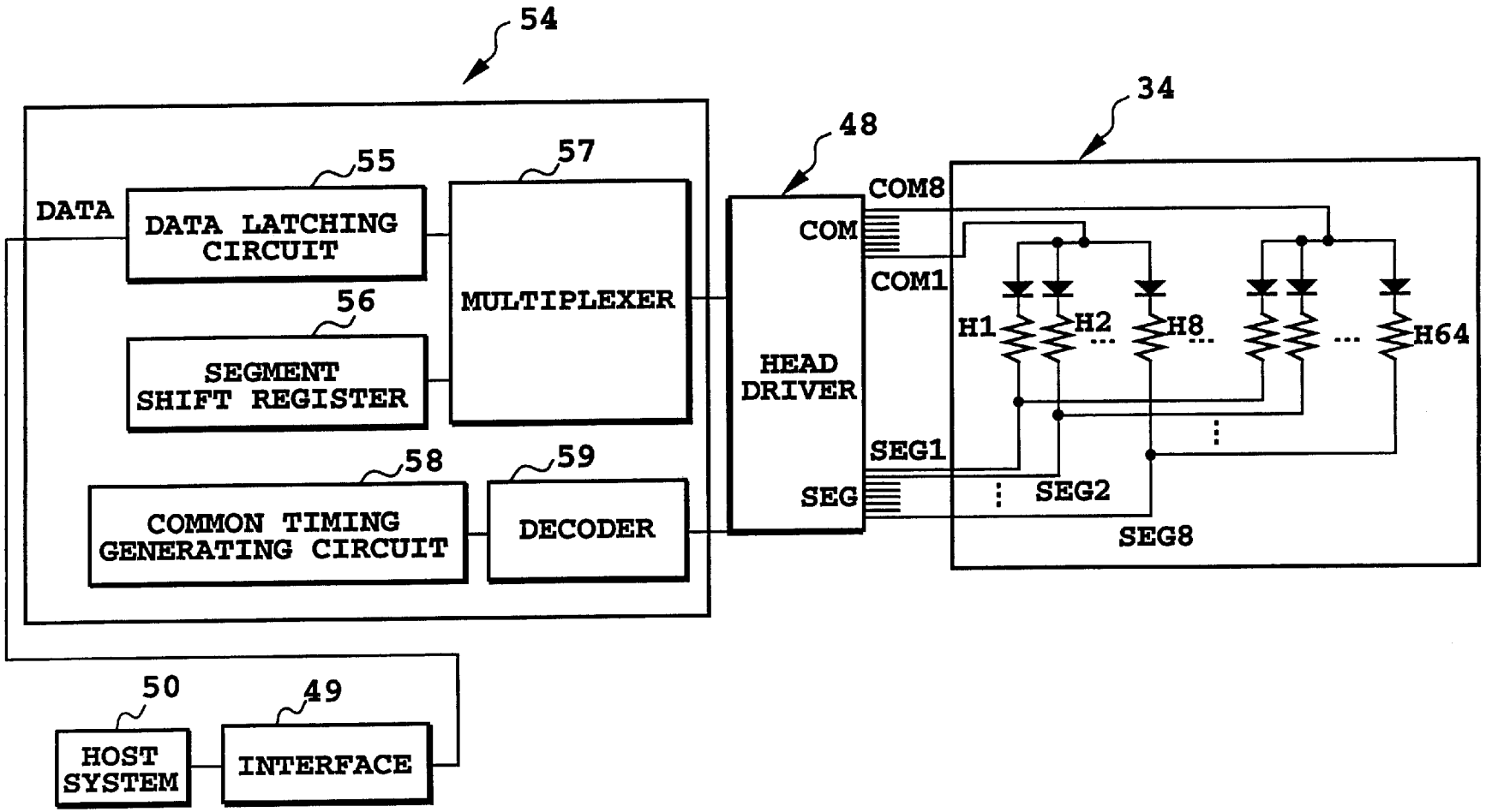
FIG. 4 is a block diagram showing a construction of a printing head driving circuit according to the present invention.

In FIG. 4 illustrating a control circuit including the gate array 54 for controlling driving of the printing head 34. The reference numeral 55 denotes a data latching circuit for receiving a signal relating to the printing data from the host system 50 in the gate array 54, 56 denotes a segment shift register holding a program relating to printing in divided fashion and supplying to a multiplexer 57, 58 denotes a common timing generating circuit and 59 denotes a decoder. On the other hand, the printing head 34 has a diode matrix arranged on the head substrate 44 for selectively driving the electrothermal transducer 43, i.e. heaters H1 to H64 in FIG. 4 by a combination of a common signal COM and a segment signal SEG supplied to the printing head 34 side via the head driver 48 to perform printing by ejecting ink from corresponding ejection opening 41.

Discussing in further detail, the decoder 59 decodes a timing generated by the common timing generating circuit 58 to select one of common signals COM1 to COM8. The data latching circuit 55 latches the 8 bit printing data read out from the DRAM 53 which is illustrated in FIG. 3. The multiplexer 57 outputs this printing data as the segment signal SEG1 to SEG8 according to the segment shift register 56. The output of the multiplexer 57 is variable depending upon the content of the shift register 56, such as 1 bit unit, 2 bit unit, all 8 bits or so forth. Therefore, in the printing control means 35, in response to inputting of the printing signal through the interface 49, the printing signal is converted into the printing data for printing between the gate array 54 and the MPU 51. Then, the motor drivers 46 and 47 are driven. In conjunction therewith, the printing head 34 is driven by the printing data fed to the head driver 48 to perform printing.

Next, procedure of control of recovery operation by suction and preparatory ejection in accordance with the present invention will be discussed with reference to FIG. 5.

It should be noted that all of control of recovery operation according to the present invention is performed by the recovery operation control means 36 as an interrupt process. At first, discussion will be given for the procedure of an interrupt process.

Figure 5:
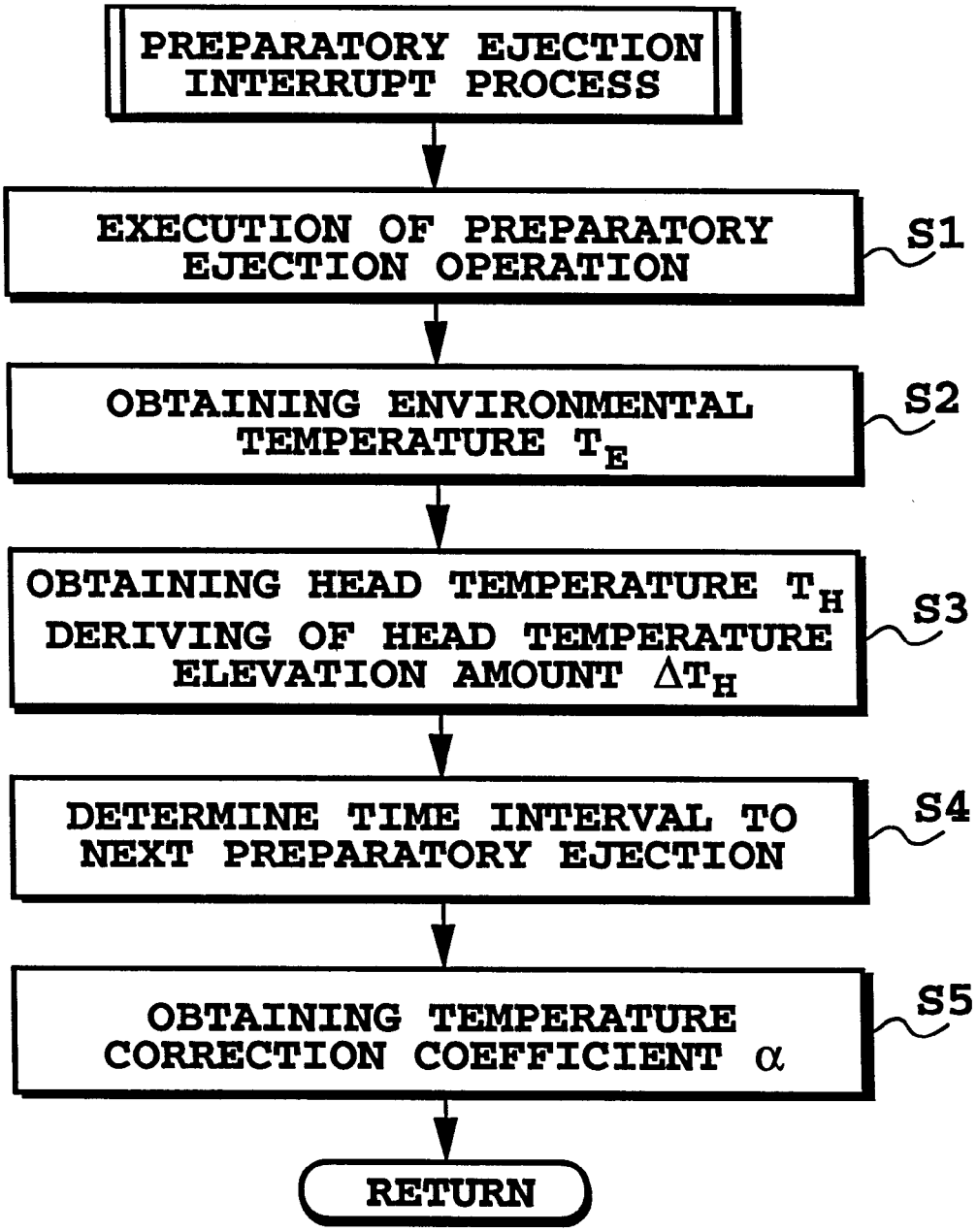
FIG. 5 is a flowchart showing the first embodiment of an operation procedure in preparatory ejection according to the present invention, together with the following FIG. 7.

Preparatory ejection interrupt process shown in FIG. 5 is initiated from obtaining of the environmental temperature $T_E$ by the environmental temperature detecting means 39. As such environmental temperature detecting means 39, any known means which can make judgement for peripheral temperature of the printing head 34 may be employed. However, it is desirable to arrange a temperature detecting element, such as thermistor or so forth, at a position where the ink temperature in the ink tank 13 can be normally detected by holding the ink supplying to the common ink chamber 45, and to monitor a value from the temperature detecting element.

When the signal for preparatory ejection interrupt process is input, a known preparatory ejection operation is performed at step S1. At subsequent step S2, the environmental temperature $T_E$ is detected or judged by the environmental temperature detecting means 39 (see FIG. 1). Then, at step S3, the temperature $T_H$ in the printing head 34 (hereinafter referred to as head temperature) is obtained to derive a degree of temperature elevation $\Delta T_H$ (hereinafter referred to as head temperature elevation amount). Here, the temperature $T_H$ in the printing head 34 is the temperature at the portion where is elevated by heating of the electrothermal transducer 43, such as the ink passage 42 or the common ink chamber 45, and means the detected temperature from the temperature detecting means 33 (see FIG. 1). However, the temperature $T_H$ may be a temperature judged from a charged energy by arithmetic operation, as disclosed in Japanese Patent Application Laying-open No. 208505/1993. It should be noted that as the temperature detecting means 33, a diode sensor integrally formed on the head substrate 44 through the semiconductor fabrication process, can be listed as one example.

In the arithmetic operation performed at the step S3, the head temperature TH can be derived by the following equation (1).

$$\Delta T_H = T_H - T_E \quad (1)$$

Next, at next step S4, a time interval to next preparatory ejection is determined on the basis of the environmental temperature $T_E$ and the head temperature elevation amount $\Delta T_H$. Also, at step S5, a temperature correction coefficient $\alpha$ is derived on the basis of the environmental temperature $T_E$ and the head temperature elevation amount $\Delta T_H$ according to the following table 1.

TEMPERATURE CORRECTION COEFFICIENT $\alpha$

| Environmental Temperature $T_E$ | Head Temperature Elevation Amount $\Delta T_H$ (deg.) | | | |
|---|---|---|---|---|
| (° C.) | 0 to 15 | 15 to 25 | 25 to 35 | 35 to 45 |
| 0 to 15 | 1.0 | 2.0 | 2.5 | 3.0 |
| 15 to 25 | 1.0 | 1.5 | 2.0 | 2.5 |
| 25 to 35 | 0.5 | 1.0 | 1.5 | 2.0 |
| 35 to 45 | 0.5 | 1.0 | 1.25 | 1.5 |

The head temperature $T_H$ used here is a temperature as considered in a time span of several seconds to several tens of seconds. In case of prediction of the head temperature $T_H$, it is preferred to use one removing a portion of time constant less than or equal to 1 second. Similarly, employing a temperature detecting means 33, it is preferred to avoid influence of temperature variation of short time constant by using the measured value at the leading end of the line where printing is not performed or in the forward travel in the case of one-way printing.

On the other hand, the above-mentioned temperature correction coefficient $\alpha$ is for providing weight as discussed later, with respect to number of dots counted by the dot counting means 38 (see FIG. 1). Reason of necessity of temperature correction coefficient $\alpha$ will be discussed hereinafter. Namely, when the ink is sequentially ejected from the printing head 34, the temperature in the vicinity of the common ink chamber 45, i.e. the head temperature $T_H$ becomes higher than the temperature in the ink tank 13, i.e. the environmental temperature $T_E$. Elevation of temperature promotes growth of bubble in the common ink chamber 45 in the following reason.

In general, solubility of gas with respect to ink is lowered according to elevation of the temperature. In case of the ink flowing into the high temperature common ink chamber 45 from the ink tank 13, a part of the dissolved gas separate from the ink to becomes super saturated condition. Then, the separated dissolved gas resides in the common ink chamber 45 to grow as bubble by coalescence. Accordingly, growth of bubble in the common ink chamber 45 by printing is considered to be proportional to a product of multiplication of a variation amount of the gas solubility due to difference of the head temperature $T_H$ and the temperature of the ink tank 13 (nearly equal to the environmental temperature $T_E$), and an ink amount passing through the printing head 34 (product of ejection volume and number of times of ejection).

Figure 6:
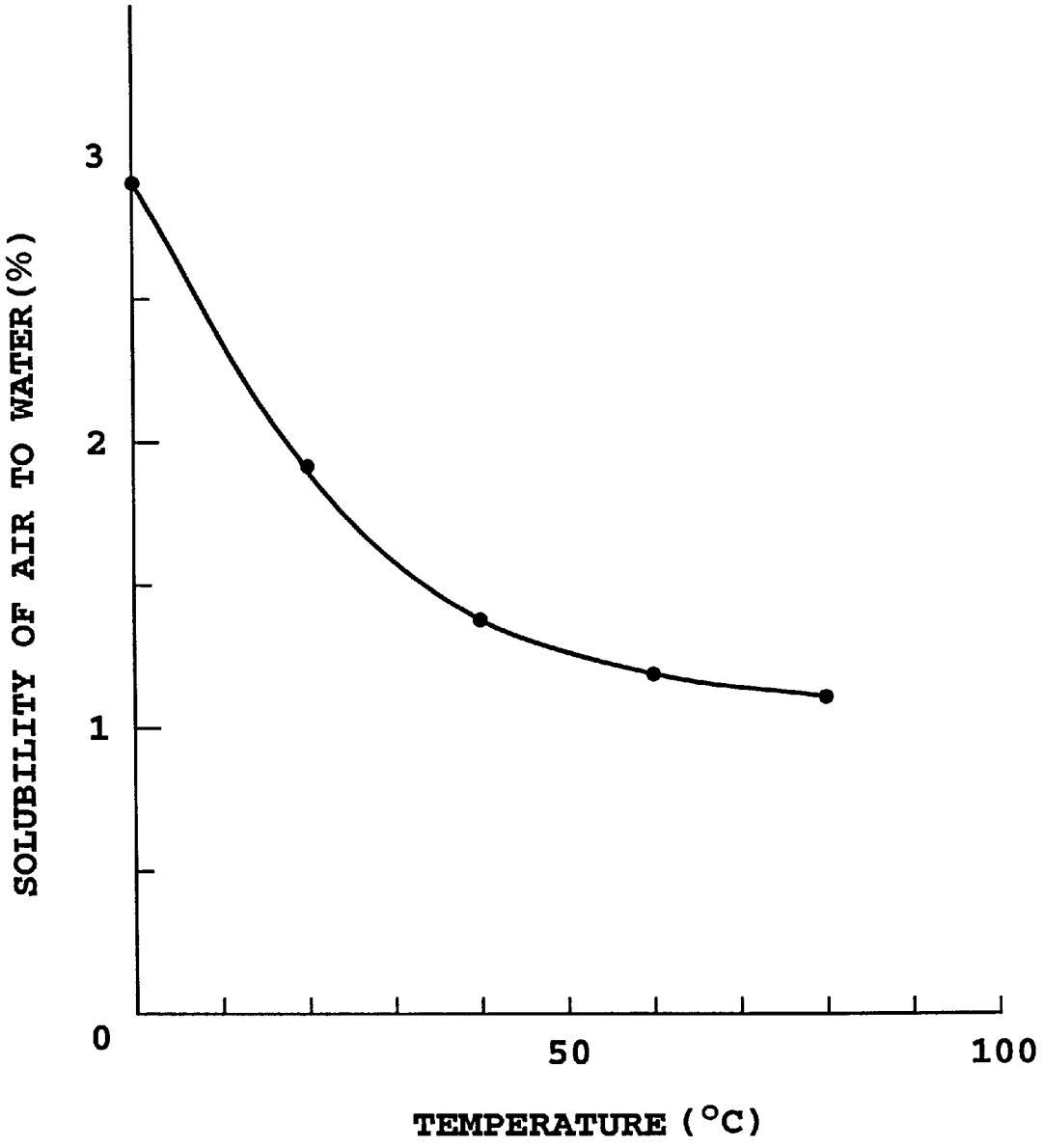
FIG. 6 is a graph showing a relationship between a temperature and a solubility of air to water.

This will be discussed in more concretely. FIG. 6 is a graph showing a relationship of temperature and solubility of air to water. As can be seen, solubility of air to water is higher at lower temperature. The solubility of air to the ink containing water as primary component is considered to have similar tendency. Therefore, from this figure, two things can be appreciated. One thing is that separation amount of gas becomes greater at greater temperature elevation amount. Another thing is that separation amount of gas becomes greater at lower initial environmental temperature. Accordingly, when the temperature elevation amount is large and the environmental temperature is low, separation amount of gas in printing of the same dot number becomes greater. The temperature correction coefficient $\alpha$ is set in consideration of this fact.

Figure 7:
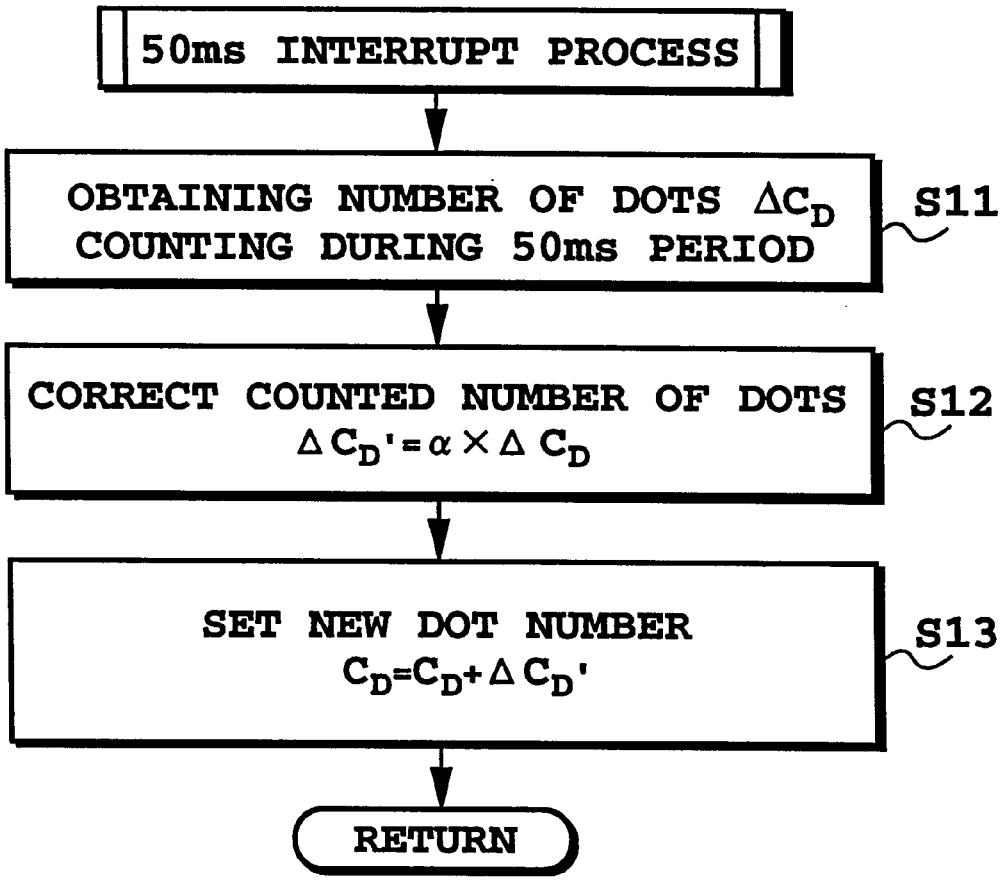
FIG. 7 is a flowchart showing the first embodiment of an operation procedure in preparatory ejection according to the present invention.
Figure 8:
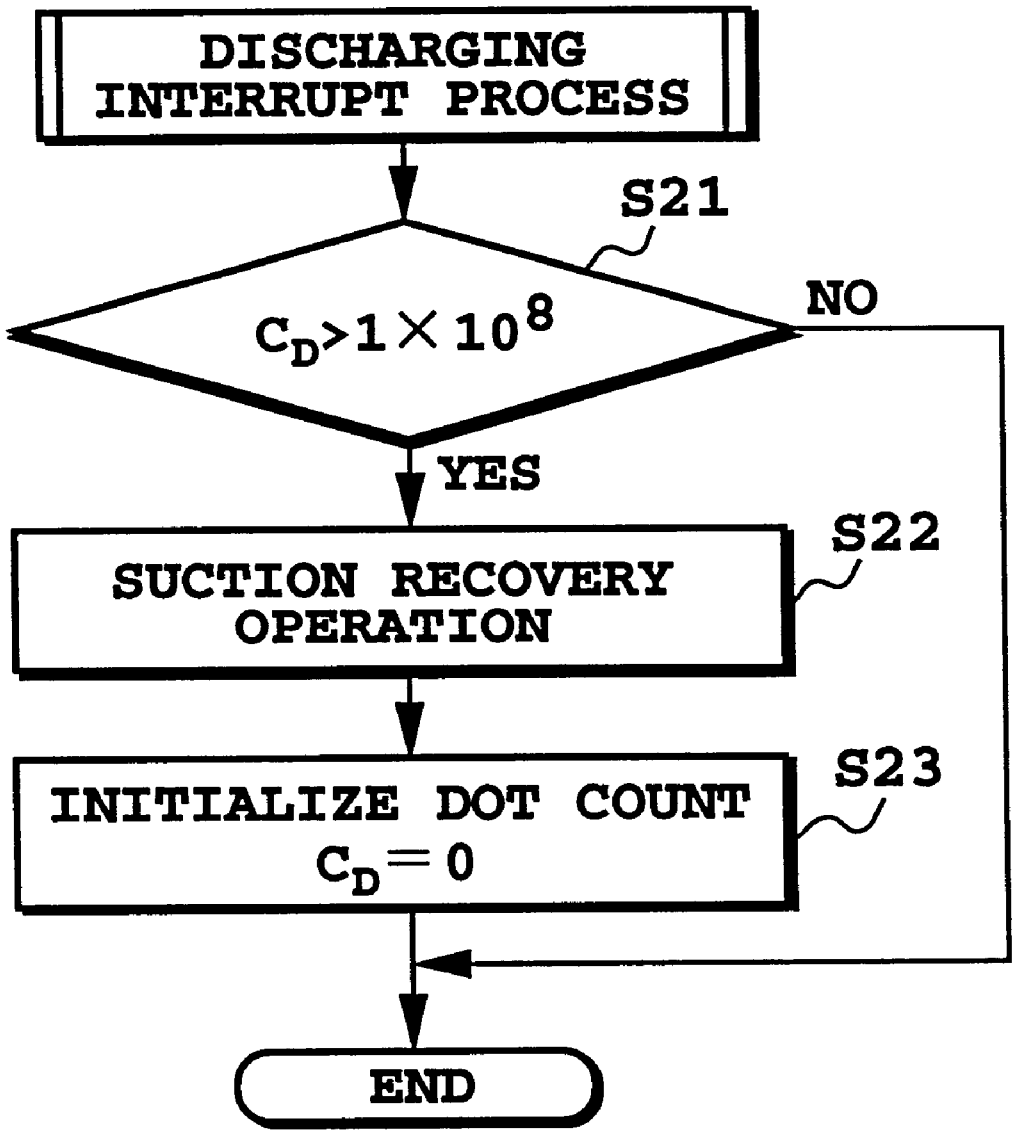
FIG. 8 is a flowchart showing the first embodiment of a control procedure for suction recovery operation upon ejection, according to the present invention.

In the shown embodiment, during interrupt process for performing preparatory ejection, with using the temperature correction coefficient $\alpha$ derived as set forth above, number of dots is counted by the dot counting means 38, as shown in FIGS. 7 and 8. At first, discussion will be given for the procedure of counting of number of dots to be printed by the printing head 34 to be derived by interrupt process per every 50 ms.

In this process, at step S11, number of dots ACD printed during a period of 50 ms from the interrupt signal is counted. Then, in next step S12, the counted number of dots $\Delta C_D$ is multiplied by the temperature correction coefficient $\alpha$ for deriving a corrected number of dots $\Delta C_D'$ through the following equation (2):

$$\Delta C_D' = \alpha \times \Delta C_D \quad (2)$$

Then, at step S13, the corrected number of dots $\Delta C_D'$ derived as set forth above is added to the number of dots $C_D$ counted by the dot counting means 38 up to the current timing from a timing where the immediately preceding preparatory ejection is performed to set the sum as new number of dots $C_D$. The foregoing procedure is repeated at every interrupt process per 50 ms.

FIG. 8 shows a procedure of discharging interrupt process to be executed every time of discharging of the printing medium 16. In this process, at first, judgement is made whether number of dots $C_D$ upon discharging of the medium exceeds a preliminarily set threshold value, e.g. $1\times10^8$ or not, at step S21. Then, judgement is made that the number of dots $C_D$ exceeds the threshold value, the process is advanced to step 22 to perform suction recovery operation, in which the ink is sucked from all of ejection openings 41 of the printing head 34. Then, the process is advanced to step 23 to perform initialization of the dot counting means 38 to set dot number $C_D$=0. On the other hand, when judgement is made that the number of dots $C_D$ counted up to the current timing is not reached the threshold value, e.g. $1\times10^8$ at step S21, the shown interrupt process is ended.

Next, discussion will be given for application for the ink-jet printing apparatus which can perform color printing by a printing head 34 including a plurality of ejection elements 60Y, 60M, 60C and 60B capable of ejecting four colors of inks of yellow (Y), magenta (M), cyan (C) and black (B), common ink chambers 61Y, 61M, 61C and 61B for respective colors and respective ink passages 62Y, 62M, 62C and 62B. Respective ejection elements 60Y, 60M, 60C and 60B have ejection openings opening on the ejection opening forming surfaces 40 and capable of ejecting the inks toward the printing medium 16, ink passages communicated with respective of said ejection openings and the electrothermal transducers provided in respective of the ink passages.

Figure 9:
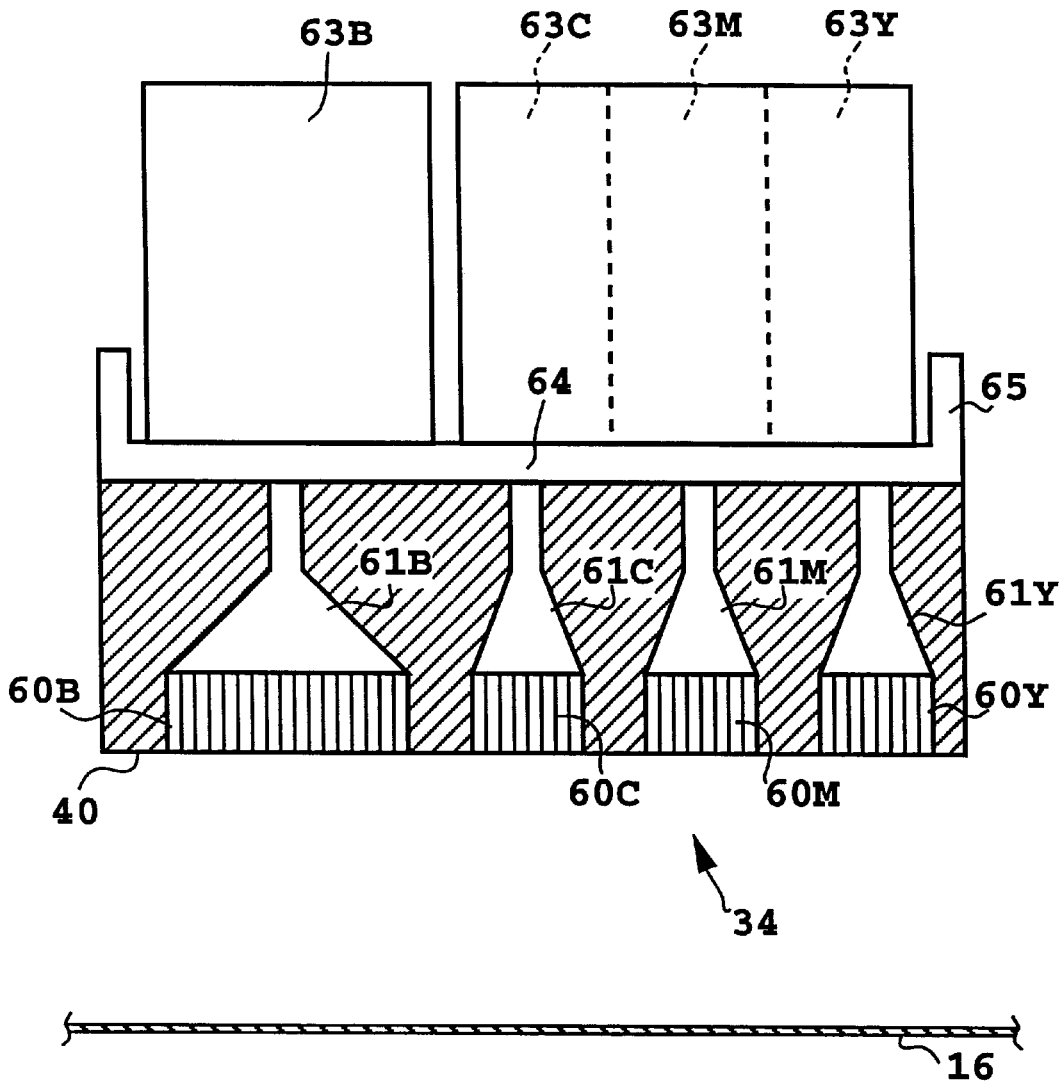
FIG. 9 is a section diagrammatically showing an example of construction of a printing head to be employed in the second embodiment of the invention.

The printing head 34 shown in FIG. 9 has a connecting portion 64 which makes the ink tanks 63Y, 63M, 63C and 63B storing above-mentioned four color inks detachable. In the connecting portion 64, not shown, communicating portions to be communicated with respective of not shown ink supplying passages of respective ink tanks 63Y, 63M, 63C and 63B, are provided. By loading the ink tanks 63Y, 63M, 63C and 63B, the ink within respective ink tanks 63Y, 63M, 63C and 63B are supplied to the printing head 34 via the communicating portion. In this embodiment, the ink tanks 63Y, 63M and 63C for color inks are integrated, and these color ink tanks 63Y, 63M and 63C with the ink tank 63B for the black ink are detachably held on the cup-shaped tank supporting portion 65 provided on the printing head 34. However, similarly to the ink tank 63B for the black ink, the ink tanks 63Y, 63M and 63C for the color inks may be separate structure. When the inks in the ink tanks 63Y, 63M, 63C and 63B is spent out, the ink tanks may be exchanged with new ink tanks.

Figure 10:
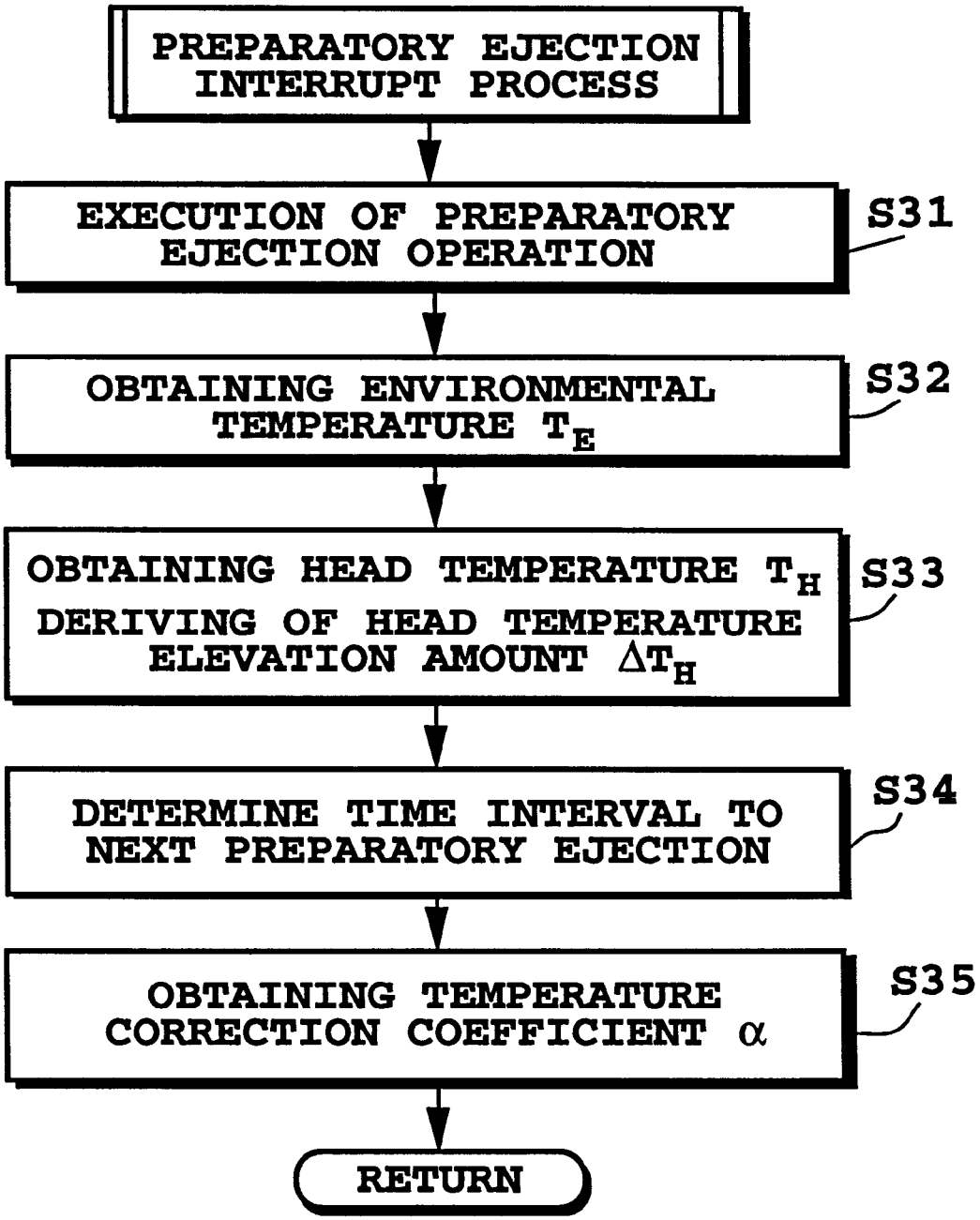
FIG. 10 is a flowchart showing the second embodiment of the control procedure of preparatory ejection operation according to the invention, together with FIG. 11.
Figure 11:
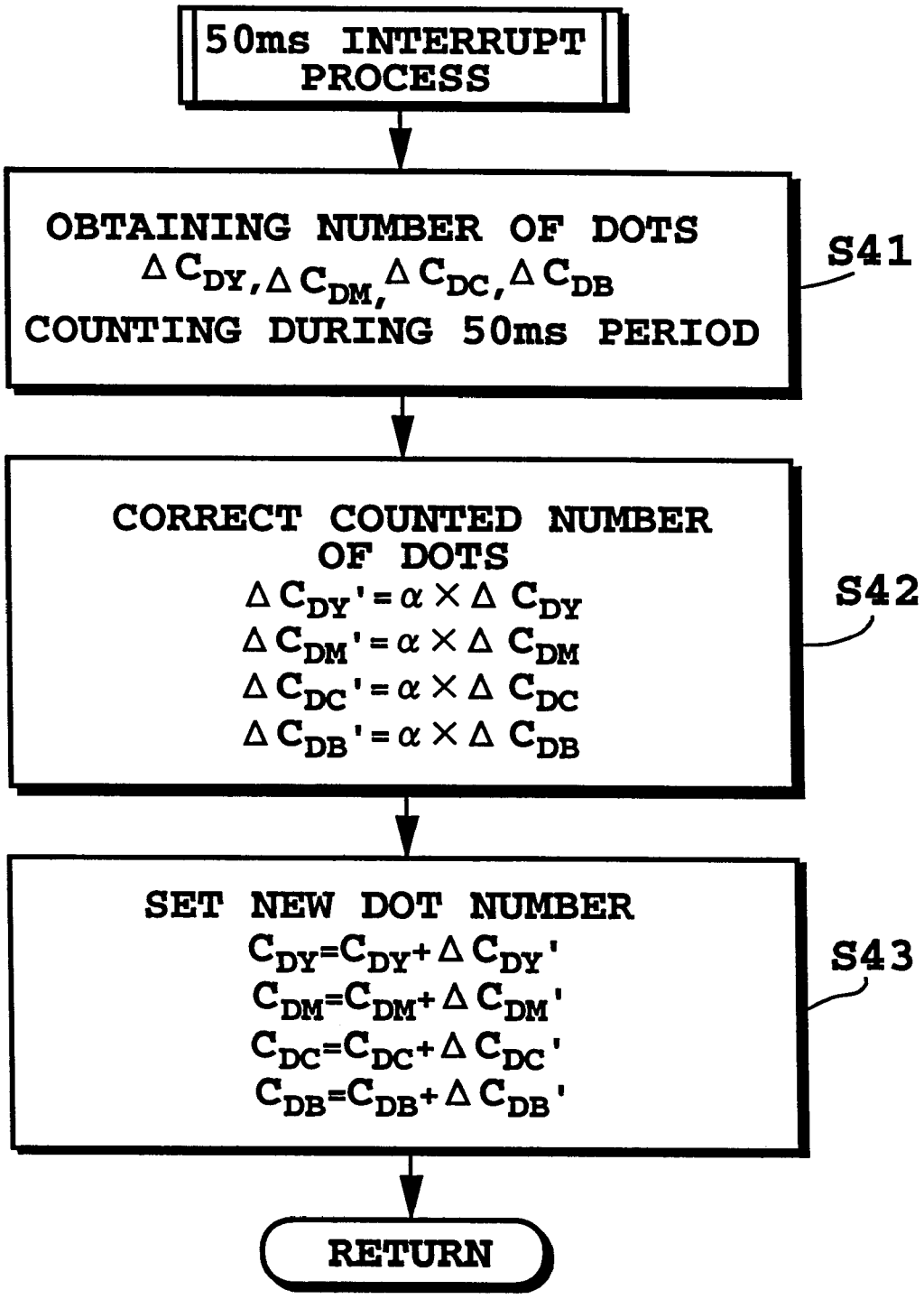
FIG. 11 is a flowchart showing the second embodiment of the control procedure of preparatory ejection operation according to the invention.
Figure 12:
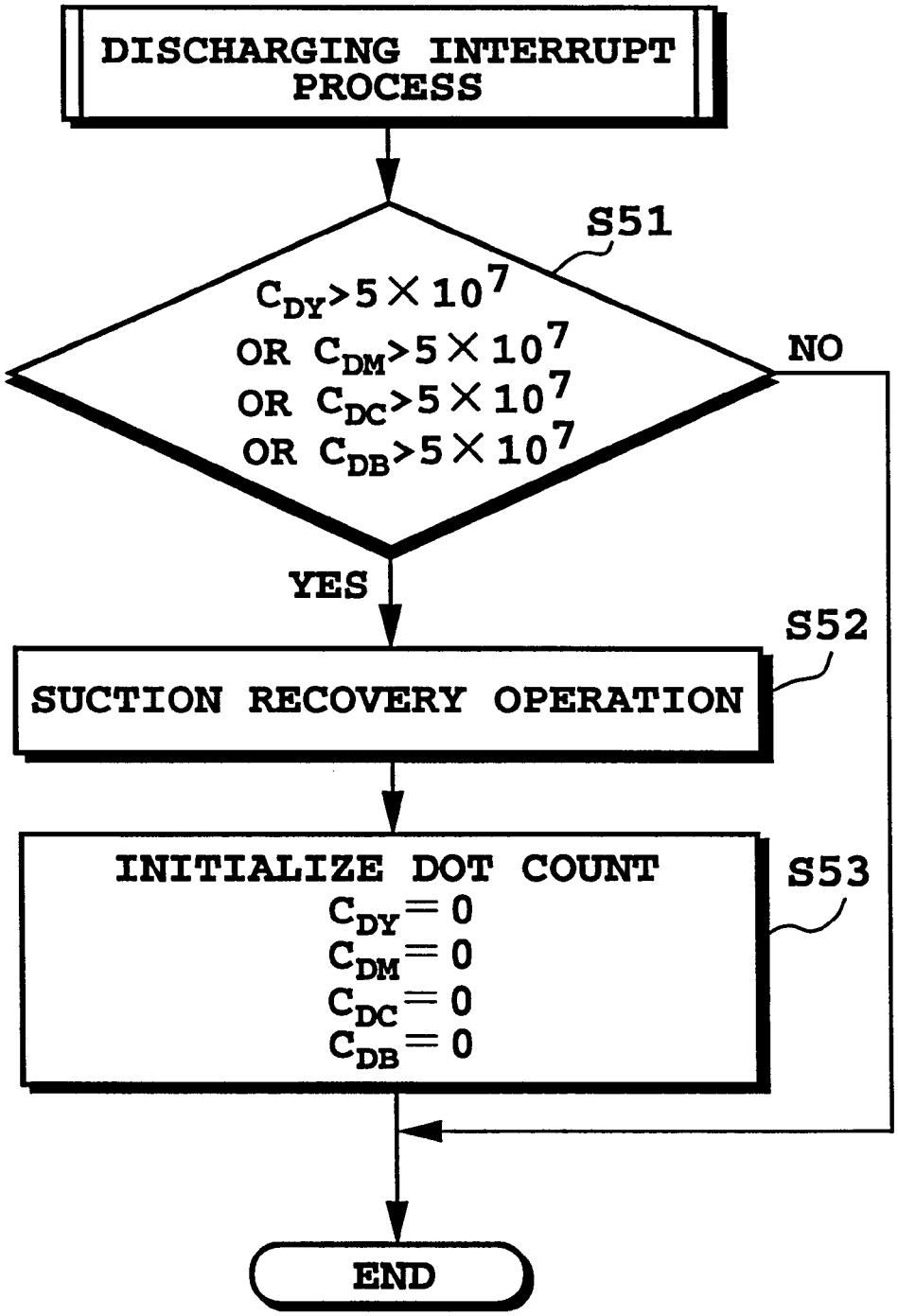
FIG. 12 is a flowchart showing the second embodiment of a control procedure for suction recovery operation upon ejection, according to the present invention.

With reference to FIGS. 10 and 11, control procedure of the shown embodiment of the recovery operation will be discussed.

FIG. 10 shows an operational procedure in a preparatory ejection interrupt process. Operations in respective of steps S31 to S35 are not significantly differentiated from those of steps S1 to S5 shown in FIG. 5. Therefore, discussion for these steps S31 to S 35 will be neglected from the following discussion. Also, operational procedure in steps S41 to S43 of 50 ms interrupt process shown in FIGS. 11 and 12 and operational procedure in steps S51 to S53 in discharging interrupt process are not significantly differentiated from those in FIGS. 7 and 8. Therefore, discussion for these steps are also neglected from this disclosure. However, in the shown embodiment, since operation is performed for each color, the set threshold value to be used for correction of dot numbers $C_{DY}$, $C_{DM}$, $C_{DC}$ and $C_{DB}$ of respective colors is set at $5\times10^7$ which is smaller than the threshold value $1\times10^8$ shown in FIG. 8, since ejection is performed for respective colors.

In the printing head 34, in which a plurality of common ink chambers 61Y to 61B in the shown embodiment are formed on a common substrate as shown in FIG. 9, the head temperature $T_H$ may be fluctuated significantly depending upon printing duties of other colors. Therefore, it is quite insufficient for predicting degree of bubble to simply count the number of printing dots $C_{DY}$, $C_{DM}$, $C_{DC}$ and $C_{DB}$ in question. Accordingly, the process of the present invention, in which temperature correction is performed during printing for the number of dots $C_{DY}$, $C_{DM}$, $C_{DC}$ and $C_{DB}$ ejected from the printing head 34 on the basis of the environmental temperature $T_E$ and the head temperature $T_H$ demonstrates remarkable effect.

Next, discussion will be given for application to the ink-jet printing apparatus having the printing head ejecting a plurality of inks having mutually different property.

Even in the shown embodiment, the printing head performs printing with the inks of four colors of yellow (Y), magenta (M), cyan (C) and black (B) as shown in FIG. 9. In the shown embodiment, ejection of ink can be performed by the not shown electrothermal transducers formed on a common substrate. The printing head in the shown embodiment is provided with mutually independent common ink chambers, the ink tank and the ink supply passages for respective colors. However, respective color inks of yellow, magenta and cyan are super-permeable type ink containing relatively large number of surface active agent to have small surface tension, and the black ink is a an ink having relatively large surface tension to be difficult to permeate into the printing medium 16.

Figure 13:
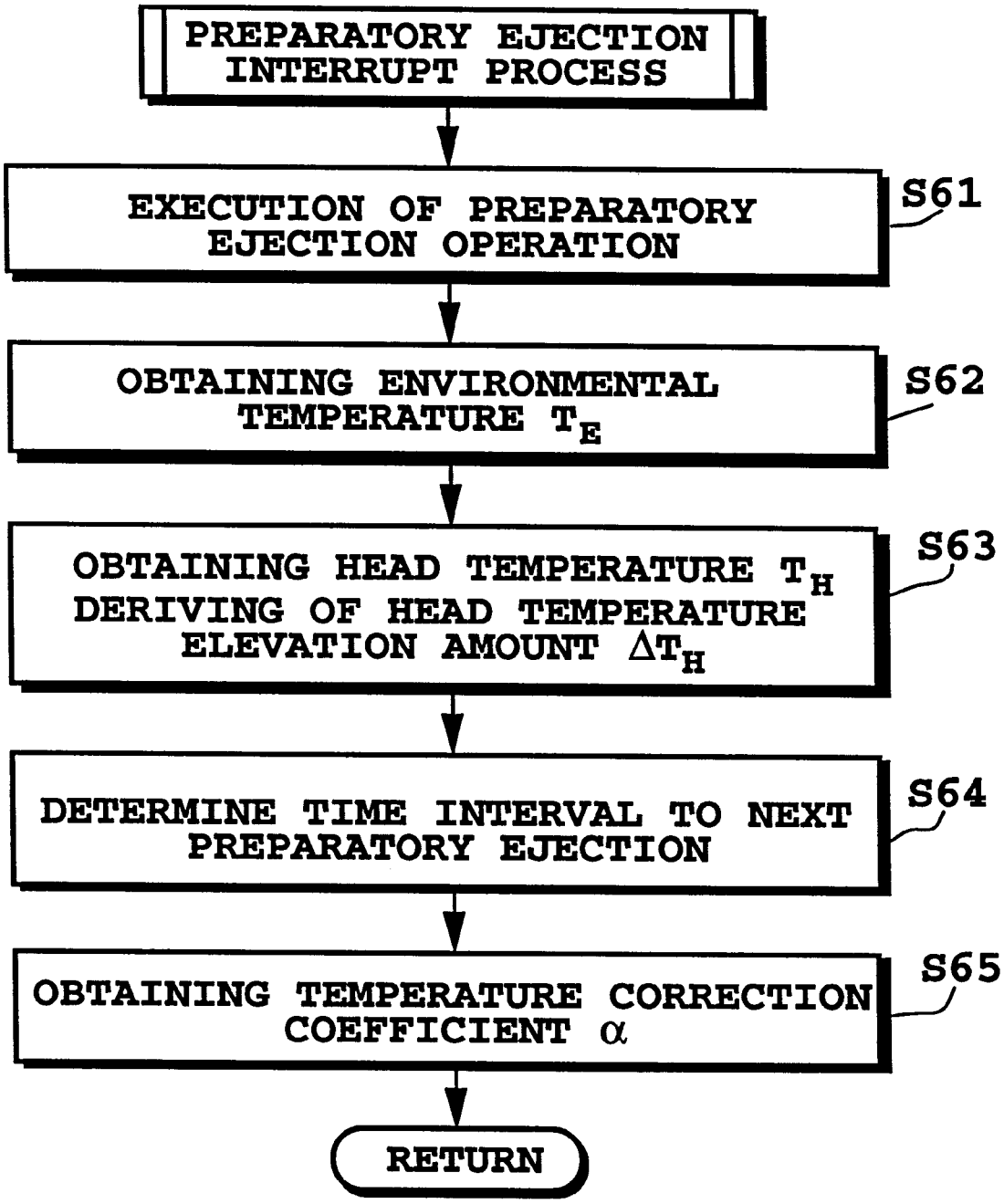
FIG. 13 is a flowchart showing the third embodiment of the control procedure of preparatory ejection operation according to the invention, together with FIG. 14.
Figure 14:
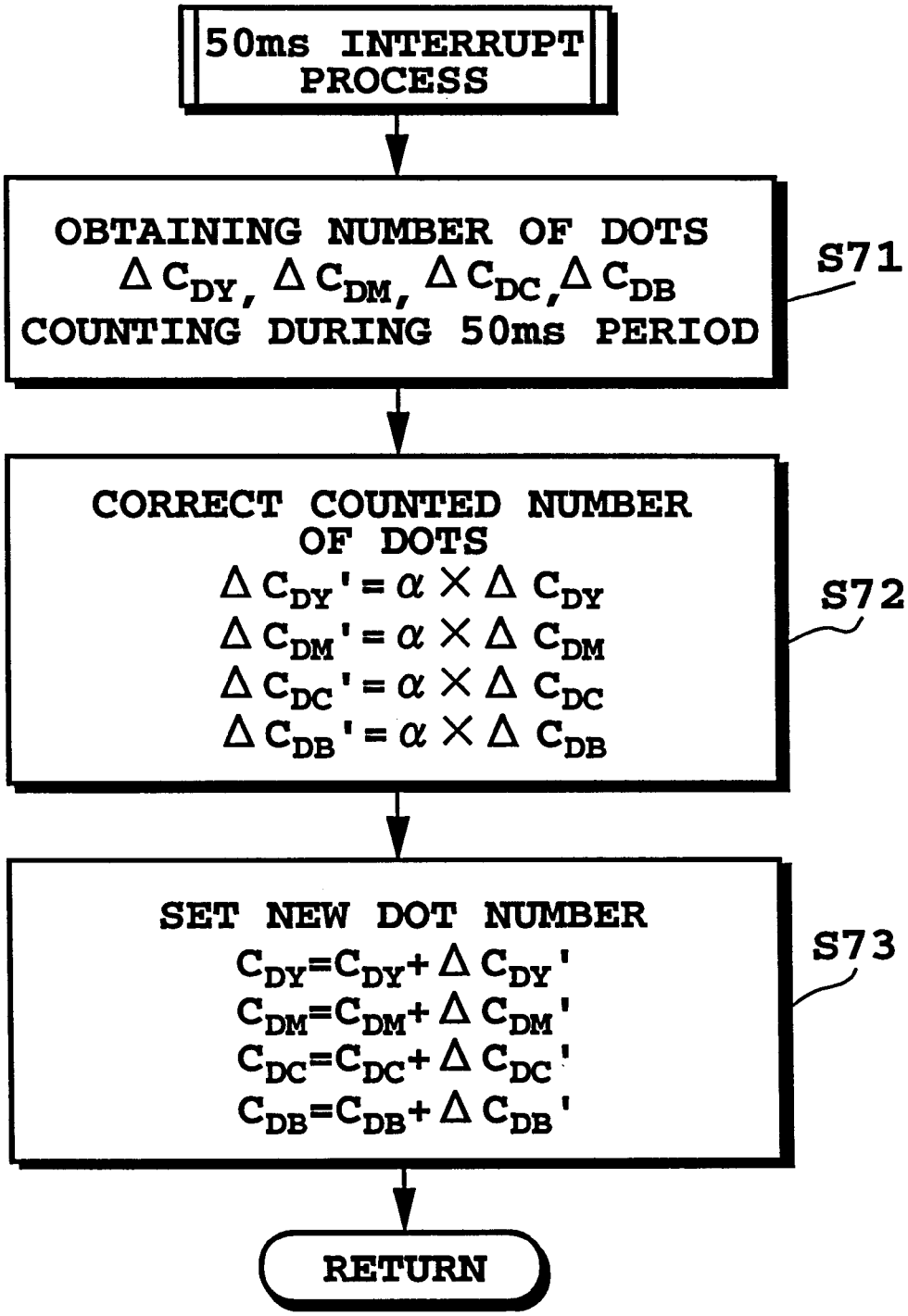
FIG. 14 is a flowchart showing the third embodiment of the control procedure of preparatory ejection operation according to the invention, together with FIG. 13.
Figure 15:
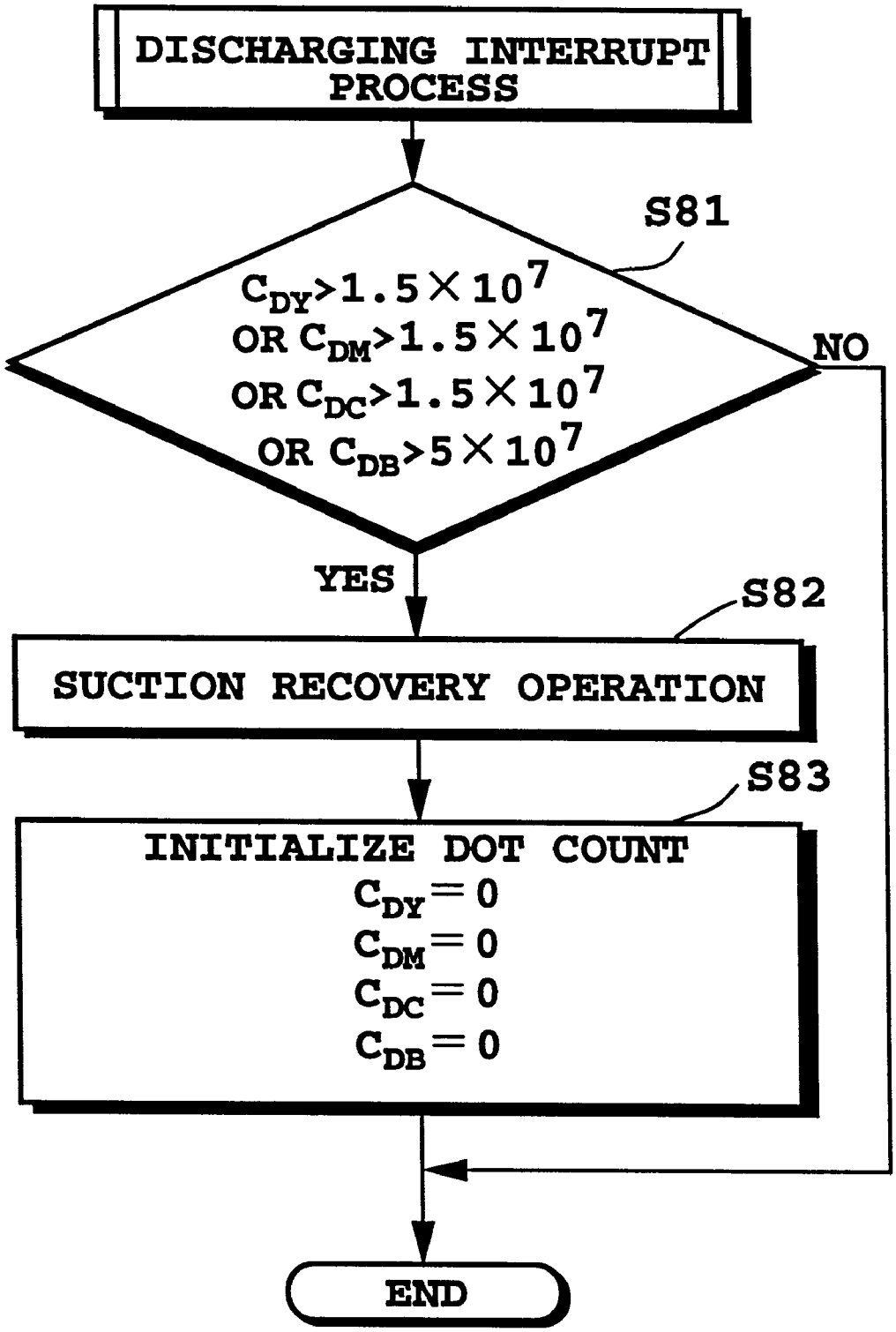
FIG. 15 is a flowchart showing the third embodiment of a control procedure for suction recovery operation upon ejection, according to the present invention.

The shown embodiment is an application for an important technology which has been developed for obtaining high printing quality in black characters and for minimizing bleeding between color inks. Control procedure of recovery operation in the shown embodiment is illustrated in FIGS. 13 to 15. FIG. 13 shows an operational procedure in the preparatory ejection interrupt process. The operation in respective color through steps S61 to S65 correspond to those in steps S1 to S5 of FIG. 5. Since basic operation in these steps are not different, discussion will be neglected. Also, steps S71 to S73 in FIG. 14 showing procedure in the 50 ms interrupt process and steps S81 to S83 of FIG. 15 showing procedure in the discharging interrupt process, per each color are also not differentiated significantly, the discussion therefor will be neglected.

In the 50 ms interrupt process of FIG. 14, the corrected number of dots $\Delta C_{DY}$, $\Delta C_{DM}$, $\Delta C_{DC}$ and $\Delta C_{DB}$ for respective color are derived by multiplying the measured number of dots $\Delta C_{DY}$, $\Delta C_{DM}$, $\Delta C_{DC}$ and $\Delta C_{DB}$ measured in the 50 ms period by the temperature correction coefficient $\alpha$, at step S72. Then, the corrected number of dots $\Delta C_{DY}$, $\Delta C_{DM}$, $\Delta C_{DC}$ and $\Delta C_{DB}$ are added to the number of dots $C_{DY}$, $C_{DM}$, $C_{DC}$ and $C_{DB}$ as counted value up to the current timing to derive new number of dots $C_{DY}$, $C_{DM}$, $C_{DC}$ and $C_{DB}$, at step S73.

In the discharging interrupt process of FIG. 15, at step S81, among number of dots $C_{DY}$, $C_{DM}$, $C_{DC}$ and $C_{DB}$ of respective colors, judgement is made whether any one of the number of dots exceeds the predetermined threshold value ($1.5\times10^7$ for color ink and $5\times10^7$ for black ink). If any one of the number of dots $C_{DY}$, $C_{DM}$, $C_{DC}$ and $C_{DB}$ exceeds the threshold value, suction recovery operation is performed at step S82. Then, at step S83, all of numbers of dots $C_{DY}$, $C_{DM}$, $C_{DC}$ and $C_{DB}$ for all of colors are initialized.

As discussed above, in case of printing head which can eject a plurality of colors of inks having different property, printing failure due to bubble generated in the common ink chamber during printing by setting the threshold value of the ink which is easy to cause printing failure due to bubble, at minimum value.

In the shown embodiment, the set threshold value for the black ink is set at a value approximately three times of that of the color ink, it is desirable to set the threshold value at the optimum value for the construction of the printing head and the printing apparatus. Furthermore, for simplification of construction, it is possible not to perform counting of the number of dots of the black ink which rarely cause printing failure and to perform counting of the number of dots only for the color inks to determine the next timing of the suction recovery operation.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 6847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing method for performing printing by ejecting ink toward a printing medium by employing a printing head having ink passages for ejecting ink through ejection openings and a common ink chamber supplying said ink into said ink passages, comprising the steps of:

detecting a peripheral temperature of said printing head;

detecting a variation of a temperature within said printing head;

counting a number of times of ejection of said ink;

performing a suction recovery operation for sucking and discharging at least said ink from said printing head through said ejection openings;

setting a timing for a next suction recovery operation based on the peripheral temperature of said printing head, the temperature variation within said printing head and said number of times of ejection of said ink;

correcting said number of times of ejection of said ink for setting the timing for the next suction recovery operation based on a difference between said peripheral temperature of said printing head and said temperature variation within said printing head;

performing preparatory ejection for ejecting said ink through said ejection openings toward an object other than said printing medium; and setting a timing for a next preparatory ejection based on said peripheral temperature of said printing head and said temperature variation within said printing head.

2. An ink-jet printing method as claimed in claim 1, wherein, in said correcting step, said correction of said number of times of ejection of said ink based on said difference between said peripheral temperature of said printing head and said temperature variation within said printing head, is performed per the preparatory ejection operation.

3. An ink-jet printing method as claimed in claim 1, wherein the timing for the next suction recovery operation is a time at which said number of times of ejection of said ink exceeds a preliminarily set threshold value.

4. An ink-jet printing method as claimed in claim 3, wherein said preliminarily set threshold value is set to be smaller for ink in which bubble generation is easier.

5. An ink-jet printing apparatus for performing printing by ejecting ink toward a printing medium by employing a printing head having ink passages for ejecting ink through ejection openings and a common ink chamber supplying said ink into said ink passages, comprising:

means for detecting a peripheral temperature of said printing head;

means for detecting a variation of a temperature within said printing head;

means for counting a number of times of ejection of said ink; and suction recovery means for performing a suction recovery operation for sucking and discharging at least said ink from said printing head through said ejection openings;

suction recovery control means for setting a timing for a next suction recovery operation based on the peripheral temperature of said printing head, the temperature variation within said printing head and said number of times of ejection of said ink;

said suction recovery control means correcting said number of times of ejection of said ink for setting the timing for the next suction recovery operation based on a difference between said peripheral temperature of said printing head and said temperature variation within said printing head;

preparatory election means for performing preparatory election for ejecting said ink through said election openings toward an object other than said printing medium; and preparatory election control means for setting a timing for a next preparatory election based on said peripheral temperature of said printing head and said temperature variation within said printing head.

6. An ink-jet printing apparatus as claimed in claim 5, wherein correction of said number of times of ejection of said ink based on said difference between said peripheral temperature of said printing head and said temperature variation within said printing head, is performed per said preparatory ejection operation by said preparatory ejection means.

7. An ink-jet printing apparatus as claimed in claim 5, wherein said ink passages of said printing head are divided into at least two or more blocks.

8. An ink-jet printing apparatus as claimed in claim 7, wherein said printing head has common ink chambers storing inks of different colors per respective ones of said blocks, and performs printing by ejecting said inks of at least two or more colors.

9. An ink-jet printing apparatus as claimed in claim 7, wherein said timing for a next suction recovery operation set by said suction recovery control means is a time at which said number of times of ejection of said ink in at least one of said blocks exceeds a preliminarily set threshold value.

10. An ink-jet printing apparatus as claimed in claim 9, wherein said preliminarily set threshold value is smaller for an ink in which bubble generation is easier among said inks in at least two or more blocks.

11. An ink-jet printing apparatus as claimed in claim 7, wherein said inks are yellow, magenta and cyan inks.

12. An ink-jet printing apparatus as claimed in claim 11, wherein said inks are a super-permeable ink containing large amount of a surface active agent and having low surface tension.

13. An ink-jet printing apparatus as claimed in claim 5, wherein said printing head has electrothermal transducers providing thermal energy to said ink for ejection of the ink, in respective ones of said ink passages.

14. An ink-jet printing apparatus as claimed in claim 5, wherein said printing head is integrally formed with an ink tank storing said ink, is exchangeably loaded on a carriage for scanning motion, and is a serial type to perform printing by ejecting said ink during scanning motion of the carriage.

15. An ink jet printing apparatus as claimed claim 5, wherein said printing head has a connecting portion which enables attaching and detaching to an ink tank storing said ink.

* * * * *

UNITED STATES PATENT AND TRADEMARK OFFICE

CERTIFICATE OF CORRECTION

PATENT NO. : 6,193,351 B1
DATED : February 27, 2001
INVENTOR(S) : Hisao Yaegashi et al.

It is certified that error appears in the above-identified patent and that said Letters Patent is hereby corrected as shown below:

Column 1,
Line 12, "for" should be deleted;
Line 24, "lesser" should read -- less --;
Line 32, "buble" should read -- a bubble --;
Line 39, "in" should read -- from the --;
Lines 58 and 66, "bubble" should read -- a bubble --; and
Line 65, "a" should be deleted.

Column 2,
Line 4, "be caused" should read -- cause --;
Line 6, "of waste" should read -- waste of --;
Line 7, "interval" should read -- intervals --; and
Line 8, "recovery" should read -- recover operations --.

Column 3,
Line 2, "ink; and" should read -- ink; --;
Line 48, "such" should read -- such a --; and
Line 51, "block" should read -- blocks --.

Column 4,
Lines 12 and 15, "bubble" should read -- a bubble --; and
Line 27, "embodiment" should read -- embodiments --.

Column 5,
Line 6, "FIG. 13;" should read -- FIG. 13; and --;
Line 12, "EMBODIMENT" should read -- EMBODIMENTS --;
Line 20, "instance," should read -- instances, --;
Line 21, "to unnecessary" should read -- not to unncessarily --; and
Line 39, "revolution" should read -- revolutions --.

UNITED STATES PATENT AND TRADEMARK OFFICE

CERTIFICATE OF CORRECTION

PATENT NO. : 6,193,351 B1
DATED : February 27, 2001
INVENTOR(S) : Hisao Yaegashi et al.

It is certified that error appears in the above-identified patent and that said Letters Patent is hereby corrected as shown below:

Column 6,
Line 13, "the" should read -- then --;
Line 34, "feeing" should read -- feeding --; and
Lines 55, 57 and 59, "denote" should read -- denotes --.

Column 7,
Line 5, "bubble" should read -- a bubble --; and
Line 30, "In FIG. 4 illustrating" should read -- FIG. 4 illustrates --.

Column 8,
Line 26, "is" should read -- it is --; and
Line 39, "equation (1)." should read -- equation (1): --.

Column 9,
Line 9, "number" should read -- the number --;
Line 17, "bubble" should read -- the bubble --;
Line 18, "in" should read -- for --; and
Line 34, "in more" should read -- more --.

Column 10,
Line 51, "is" should read -- are --; and
Line 60, "from" should read -- in --.

Column 11,
Line 33, "a an" should read -- an --;
Line 43, "color" should read -- colors --; and
Line 44, "operation" should read -- operations --.

Column 13,
Line 6, "consists" should read -- consist --.

Column 14,
Line 64, "ink; and" should read -- ink; --.

UNITED STATES PATENT AND TRADEMARK OFFICE

CERTIFICATE OF CORRECTION

PATENT NO. : 6,193,351 B1
DATED : February 27, 2001
INVENTOR(S) : Hisao Yaegashi et al.

It is certified that error appears in the above-identified patent and that said Letters Patent is hereby corrected as shown below:

Column 15,
Lines 12, 13, 16 and 17, "election" should read -- ejection --.

Column 16,
Line 15, "large" should read -- a large --; and
Line 27, "claim 5," should read -- in claim 5, --.

Signed and Sealed this

Sixteenth Day of April, 2002

*Attest:*

*Attesting Officer*

JAMES E. ROGAN
*Director of the United States Patent and Trademark Office*